US006263521B1

(12) United States Patent
Pi

(10) Patent No.: US 6,263,521 B1
(45) Date of Patent: Jul. 24, 2001

(54) PORTABLE AND FOLDABLE CHAMBER EXCRETION POT

(76) Inventor: Ching-Tien Pi, 7FL., No. 19, Alley 1, Lane 269, Wu Shing St., Taipei (TW)

( * ) Notice: Subject to any disclaimer, the term of this patent is extended or adjusted under 35 U.S.C. 154(b) by 0 days.

(21) Appl. No.: 09/579,478

(22) Filed: May 30, 2000

(51) Int. Cl.[7] ..... A47K 11/06
(52) U.S. Cl. ..... 4/484; 4/483
(58) Field of Search ..... 4/484, 483, 307, 4/312, 902, 905, 458, 476

(56) References Cited

U.S. PATENT DOCUMENTS

| | | | | |
|---|---|---|---|---|
| 345,890 | * | 7/1886 | Farson . | |
| 2,804,121 | * | 8/1957 | Singleton . | |
| 3,118,146 | * | 1/1964 | Dorey . | |
| 3,258,291 | * | 6/1966 | Ezquerra . | |
| 3,381,315 | * | 5/1968 | Glassberg . | |
| 5,155,871 | * | 10/1992 | Sams | 4/484 |
| 5,611,092 | * | 3/1997 | Van Dusen | 4/484 |
| 6,061,845 | * | 5/2000 | Kakutani | 4/483 |
| 6,081,943 | * | 7/2000 | Garcete | 4/476 |

FOREIGN PATENT DOCUMENTS

| | | | | |
|---|---|---|---|---|
| 2232079 | * | 12/1990 | (GB) | 4/483 |
| 406269378 | * | 9/1994 | (JP) | 4/483 |

* cited by examiner

*Primary Examiner*—Steven O. Douglas
*Assistant Examiner*—Khoa D. Huynh
(74) *Attorney, Agent, or Firm*—Dougherty & Troxell

(57) ABSTRACT

A portable and foldable chamber excretion pot having a seat folder mechanism can be developed for use and foldable after being finished using it, especially suitable for carrying in a car. An elaborately designed seat folder mechanism can make a plurality of sustainers stand up or lie down and form a sloped surface when they are standing up so as to settle the pot horizontally on the car seat thereby enabling the user to comfortably and stably sit thereon.

8 Claims, 6 Drawing Sheets

PORTABLE AND FOLDABLE CHAMBER EXCRETION POT

BACKGROUND OF THE INVENTION (1) Field of the Invention

The present invention relates to a portable and foldable chamber excretion pot, and more particularly, a chamber excretion pot having a seat folding mechanism, which can be developed for use and foldable after being finished using it, especially suitable for carrying in a car.

(2) Description of the Prior Art

The most embarrassing matter for people who are driving his/her car along a rural road or on a freeway where no establishment of washrooms for public use can be found when he/she suddenly feels like unbearably excretory. Although a conventional excretion bag may be used to release the embarrassment, such a bag has no supporting means so that the user is forced to crouch over it for a long time, and in the worst case, polluting the surroundings with excretion.

There is a portable chamber excretion pot utilizing an upper half structure of a conventional closes tool. However, it is not foldable and it is bulky as well. As a result, it is impossible to put aside under the car seat. Besides, the user has to put up with the danger of beating his/her head against the car roof when crouching over the chamber pot in a limited height of the car.

SUMMARY OF THE INVENTION

The present invention has been made in order to eliminate the inconvenience inherent to the conventional techniques as mentioned above. Accordingly, it is an object of the present invention to provide a portable and foldable chamber excretion pot whose volume can be decreased when folded to save occupied spacing for the convenience of putting aside under a car seat.

It is another object of the present invention to provide a portable and foldable chamber excretion pot whose folder mechanism can be settled horizontally for the user to stably and comfortably sit thereon.

It is still another object of the present invention to provide a portable and foldable chamber excretion pot whose lid stands behind his/her hip so as to prevent the excrement from spattering here and there in the car.

To achieve these and other objects, the portable and foldable chamber excretion pot comprises an developable/foldable pot assembly with an excretion inlet thereon, a seat folder mechanism able to make a plurality of sustainers stand up or lie down on the pot assembly, a sloped surface is formed when the sustainers are standing up so as to settle the pot horizontally on the car seat thereby enabling the user to comfortable and stably sit thereon, and an excretion bag is disposed in the pot assembly under the seat pad for accepting the excrement. After excretion is finished, the bag is taken out together with its contents by hermetically sealing the bag opening. By folding the seat folder mechanism, the volume of the pot assembly is minimized and can be put away under the car seat.

BRIEF DESCRIPTION OF THE DRAWINGS

For fully understanding the nature and objects of the invention, reference should be made to the following detailed description taken in conjunction with the accompanying drawings in which.

DETAILED DESCRIPTION OF THE PREFERRED EMBODIMENT

Figure 1:
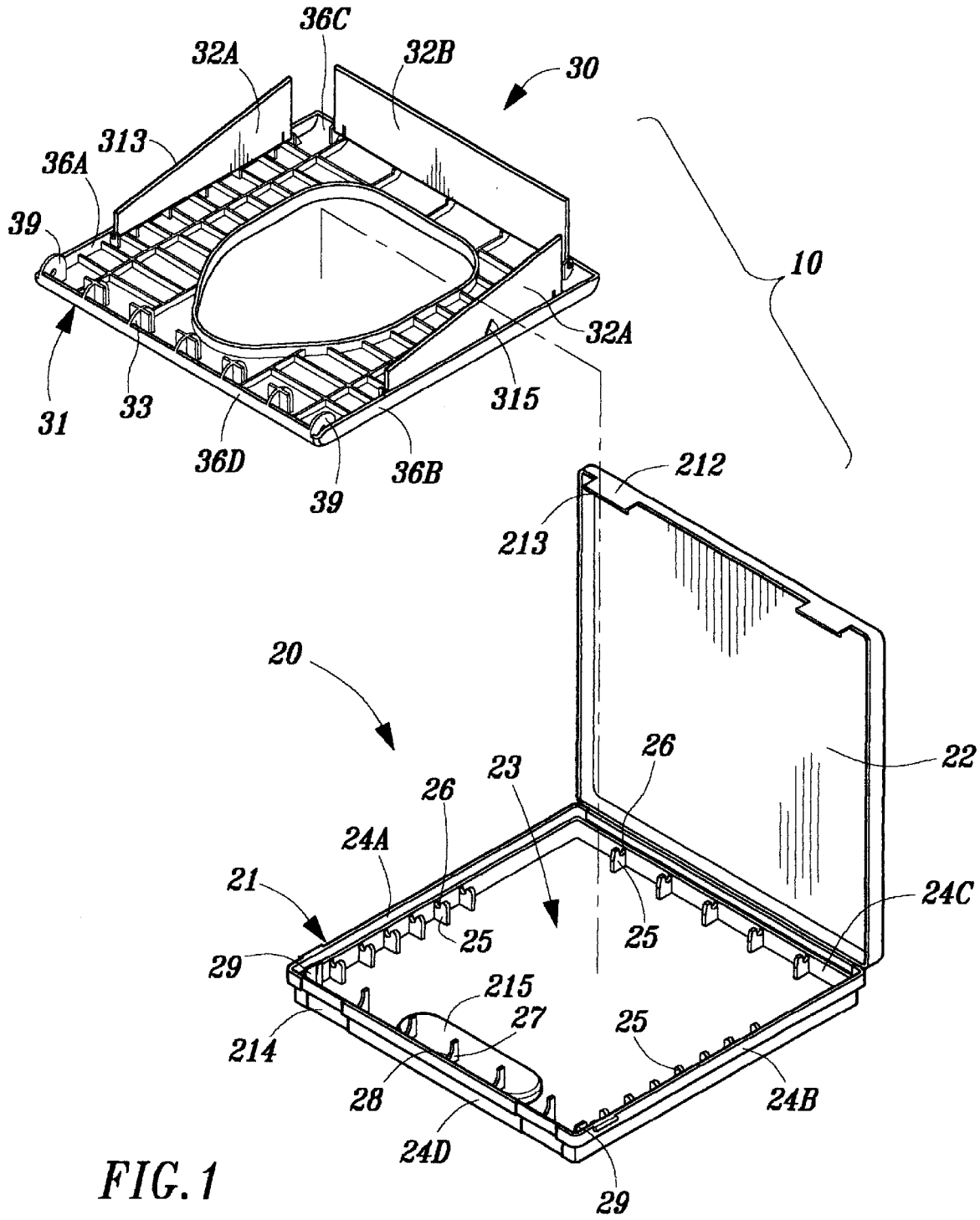
FIG. 1 is a three dimensional exploded view of the present invention.
Figure 6A:
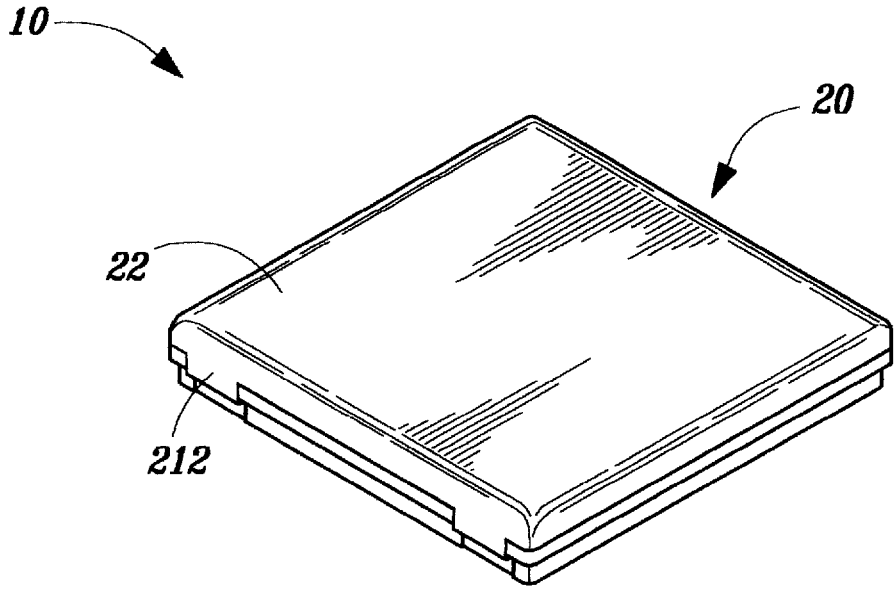
FIGS. 6A through 6D are the drawing sequentially illustrating steps of operating the chamber excretion pot of the present invention from its folded state to its developed state ready for use.
Figure 6B:
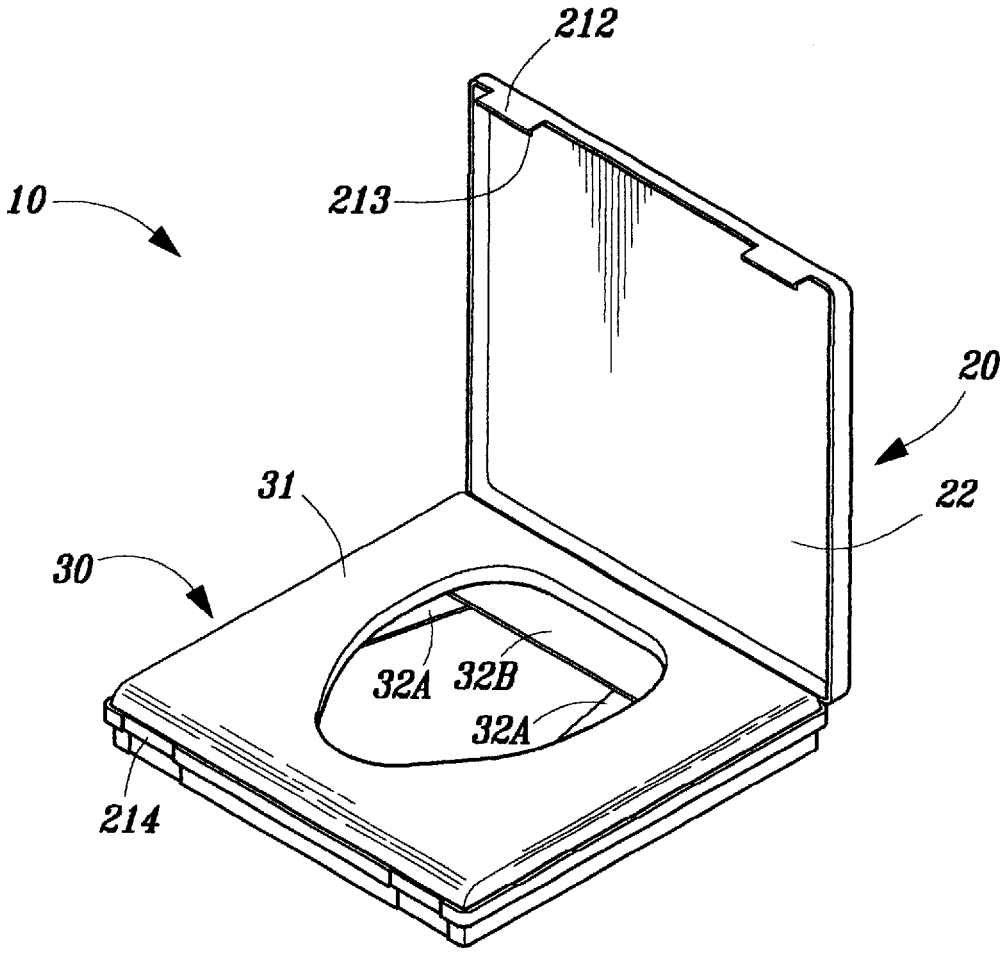
Figure 6C:
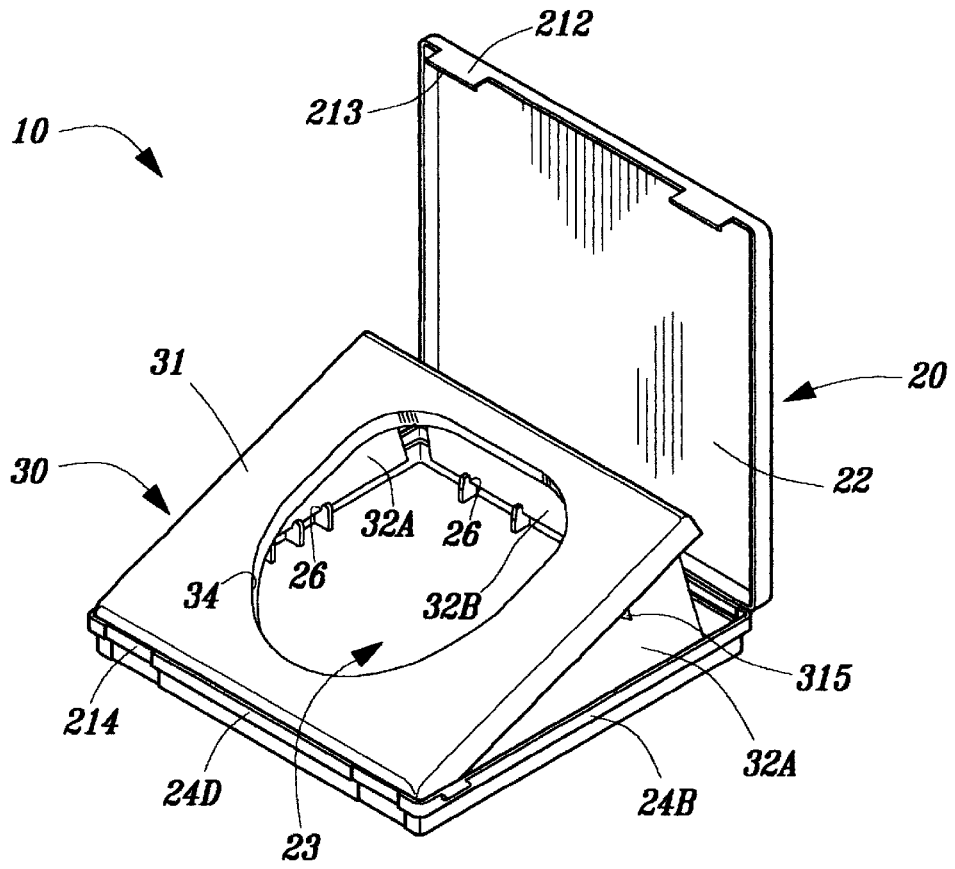
Figure 6D:
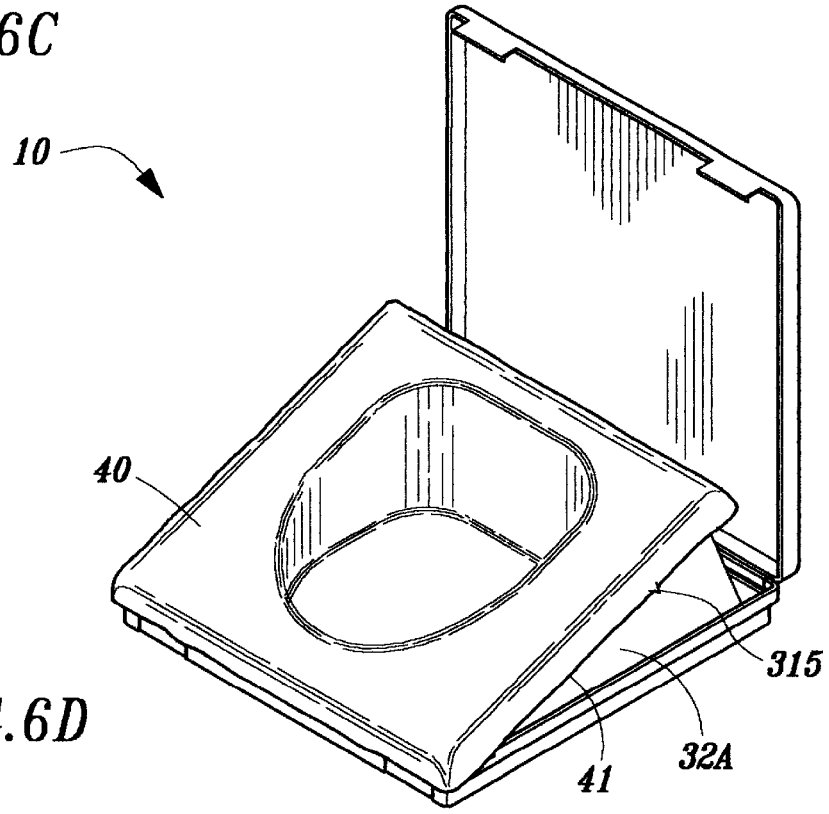

As shown in FIG. 1, the portable and foldable chamber excretion pot 10 of the present invention comprises a pot assembly 20, a seat folder mechanism 30 installed therein, and an excretion bag 40 provided under the seat folder mechanism 30 (refer to FIG. 6D). The seat folder mechanism 30 further includes a seat pad 31, one or more sustainers 32A, 32B, and a plurality of revolving members 33 arranged along the front edge 36D of the seat pad 31 with equal spacing.

Figure 2A:
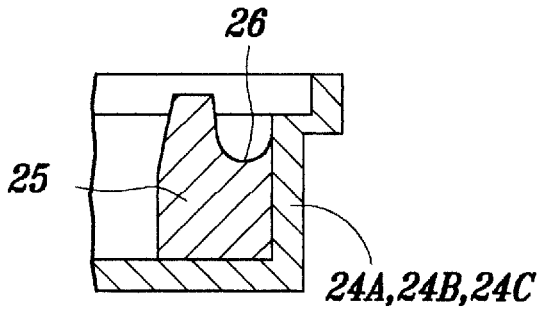
FIG. 2A is a fragmentary enlarged cross sectional view showing the clamping structure of the present invention.

A pot body 21 conjoined with a lid 22 constitutes the post assembly 20. The pot body 21 has a container 23 inside with at least one clamp 25 provided on each of three edge walls 24A, 24B, and 24C. As shown in FIG. 2A, a breach 26 is formed above each clamp 25 for accepting the bottom portion of the sustainers 32A, 32B so as to maintain them in a standing state.

Figure 2B:
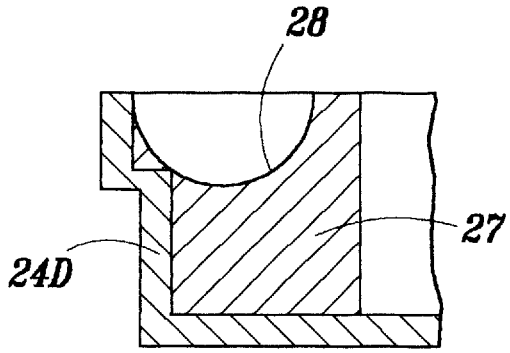
FIG. 2B is a fragmentary enlarged cross sectional view showing the supporter of the present invention.
Figure 2C:
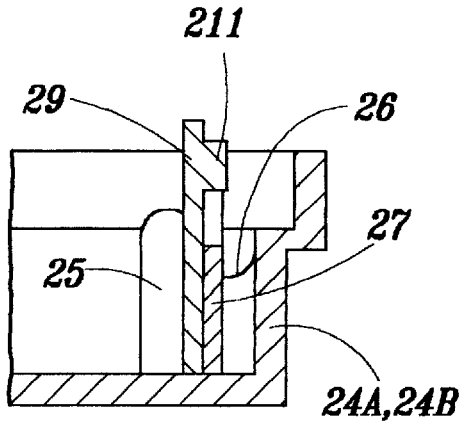
FIG. 2C is a fragmentary enlarged cross sectional view showing the mutual relationship among other components with respect to the clamping arm of the present invention.

A plurality of supports 27 are formed along another edge wall 24D of the container 23 with equal spacing each with an opening slot 28 thereon for entraining the revolving members 33 (refer to FIG. 2B). A clamping arm 29 is formed at the inner side of each supporter 27 near the edge wall 24A, 24B (refer to FIG. 2C). Each clamping arm 29 has a flange 211 at its upper end for pivoting to a clamp member 39 of the seat pad 31. The two-clamp members 39 are mounted on the both edge walls 36A, 36B at the outer side near the two end revolving members 33.

Figure 2D:
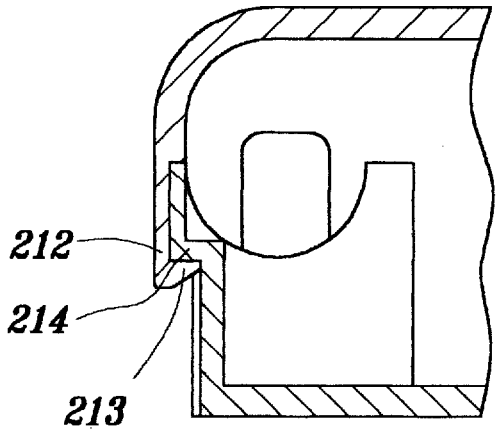
FIG. 2D is a fragmentary enlarged cross sectional view showing that the claw and the claw stop of the present invention in engagement with each other.

There is at least one hook 212 formed at an edge of the lid 22, a claw 213 is formed at the lower portion of the hook 212 for engaging to a claw stop 214 (FIG. 2D) so that the pot body 21 and the lid 22 are fitted with each other to form a closed state. The claw stop 214 is formed on the other outer surface of the edge wall 24d of the pot body 21 for the user to grasp thereat by hand when carrying the pot.

Figure 3:
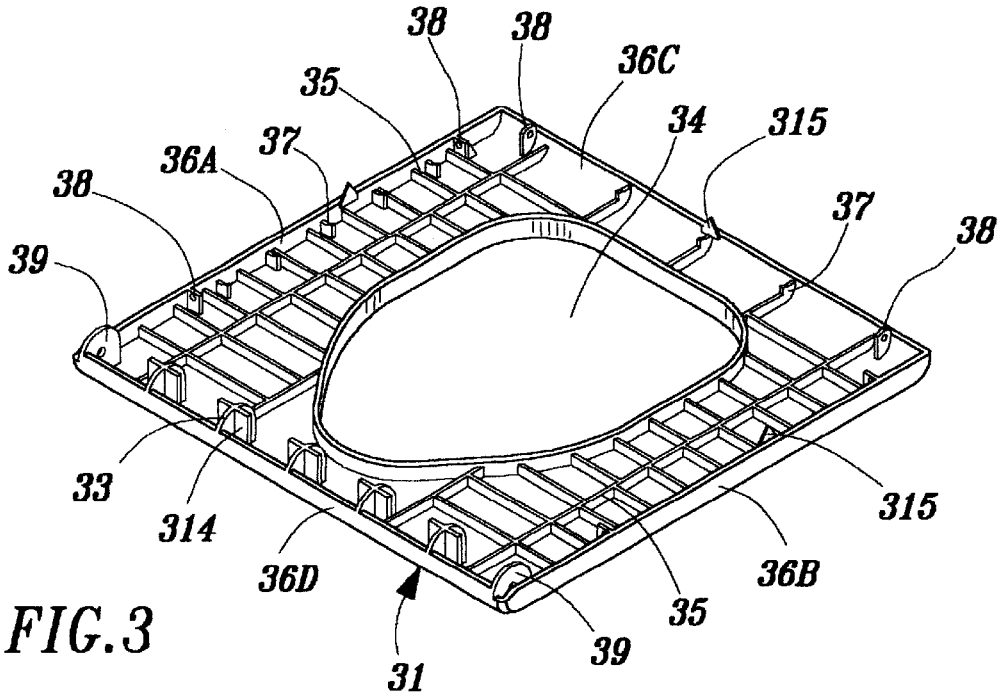
FIG. 3 is a three dimensional view of the seat pad of the present invention.
Figure 4:
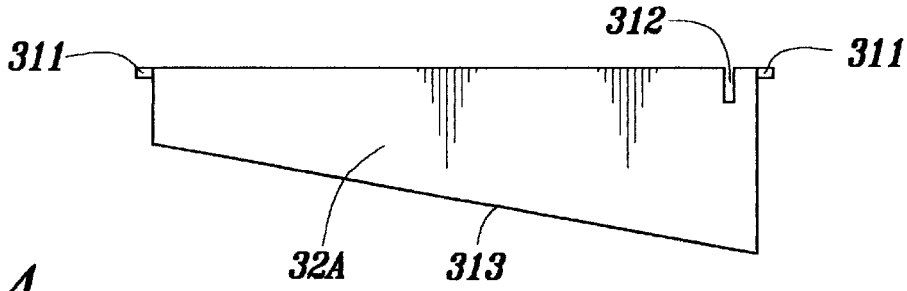
FIG. 4 and FIG. 5 are two plan views of the sustainer of the present invention.
Figure 5:
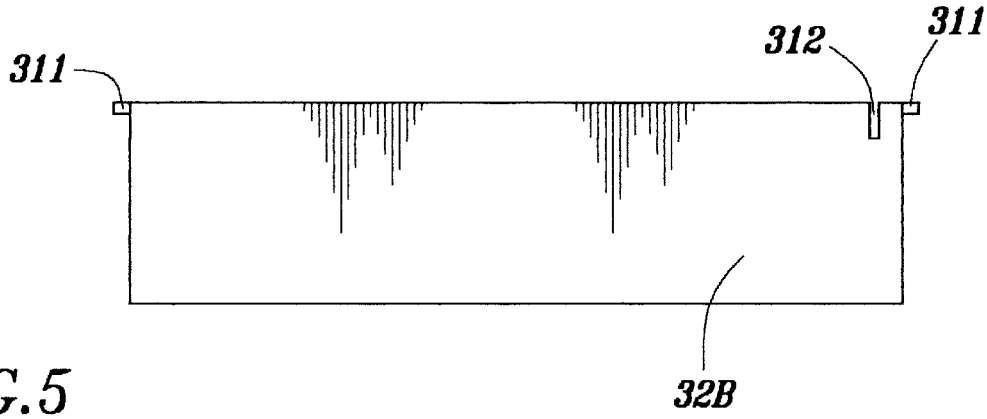

Referring to FIG. 1 together with FIG. 3, under the seat pad 31, there is an excretion inlet 34 communicating with the container 23. A plurality of reinforced ribs 35 formed in a trellis are formed at the bottom of the seat pad 31. Seat pad 31 is formed into four edge walls 36A, 36B, 36C and 36D. A plurality of brackets 37 disposed with equal spacing along the edge walls 36A, 36B, 36C, are for entraining the sustainers 32A, 32B thereon. A stop block 38 is provided for each end bracket 37 at the outer side thereof. Referring now to FIGS. 4 and 5, at both ends of the sustainers 32A, 32B, there is a pivot axis 311 provided for each sustainers 32A, 32B for pivoting with the stop blocks 38 so that the sustainers 32A, 32B are rotatable with respect to pivot axis 311. An open slot 312 provided for each sustainer 32A, 32B forms an allowable space for facilitating the joining of the pivot axis 311 and the stop block 38.

In order to provide a sloped surface when the seat folder mechanism 30 is developed, a tapered portion 313 is formed at the bottom of the sustainers 32A, when the tapered portion 313 is mounted on the breach 26, the seat pad 31 will be formed into a sloped surface whereas the sustainers 32A, 32B can lie horizontally or stand vertically beneath the seat pad 31. When the sustainers 32A, 32B are at vertical position, their bottom portions are fitted in the breaches 26.

Referring to FIG. 1 and 3 further, the revolving member 33 is an arcuate article having a stopper 314 facing against it for limiting maximum open angle of the seat folder mechanism 30. The maximum open angle is defined approximately to 20 degrees enough for the sustainers 32A, 32B to be fitted in their individual breaches 26.

A hook 315 is provided for each of the edge walls 36A, 36B, and 36C for hooking on periphery of a bag opening 41 of the bag 40 so as to prevent the bag 40 from slipping down.

FIGS. 6A through 6D are the drawings, which sequentially illustrate steps of operating the chamber excretion pot of the present invention from its folded state to its developed state ready for use. At first, pulling outward the hook 212 and moving the lid 22 upward; second, pulling up the rear part of the seat folder mechanism 30, and turning the sustainers 32A, 32B to the vertical position and fitting in individual breaches 26 therefore completing development of the chamber pot by forming a sloped surface thereon; third, the bag 40 from the excretion inlet 34 into the container 23; and finally, hooking the periphery of the bag opening 41 on the hooks 315 for preventing the bag 40 from slipping down, then the chamber pot is ready for use. After finishing the excretion, the bag opening 41 is hermetically sealed for discarding.

When folding the chamber excretion pot, by pulling up the rear part of the seat pad 31 so as to release the sustainers 32A, 32B from detention of the breaches 26; turning the sustainers 32A, 32B to lie down horizontally so that they are flat with the seat pad 31; and push down the hooks 212 to engage the claw 213 to the claw stop 214 thereby completing the folding operation. After folding, the volume of the chamber excretion pot of the present invention is minimized to a degree convenient to put aside in the car.

Figure 7:
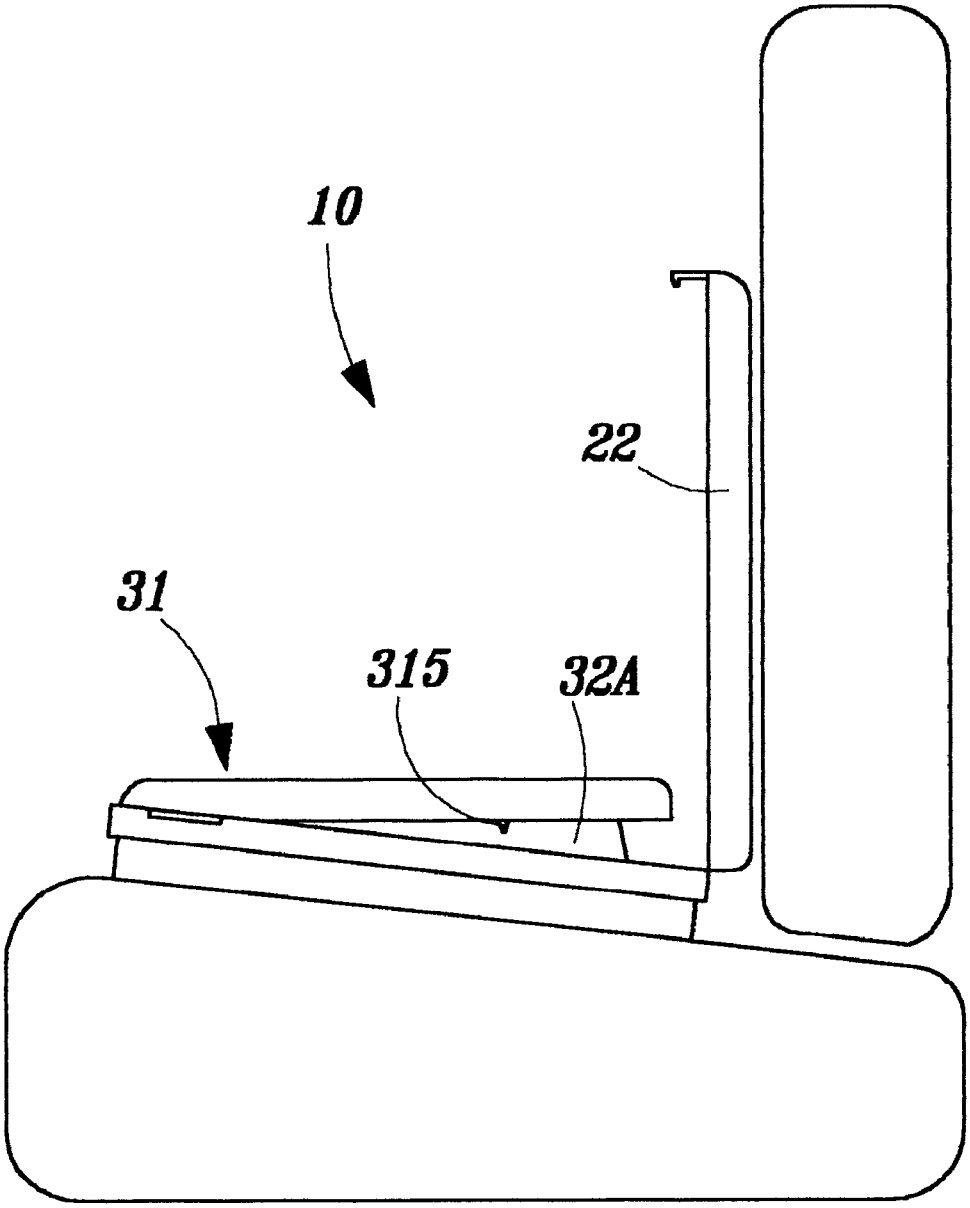
FIG. 7 is a side view of the present invention put on a car seat ready for use.

As the seat is made inclined backward for an ordinary car, when the chamber excretion pot 10 of the present invention is set on the car seat, as shown in FIG. 7, its seat pad 31 is almost maintained horizontal so that the user is able to comfortably and stably sit thereon. Besides, the lid 22 is standing exactly behind the user's hip for preventing the excretion from spattering here and there in the car.

The invention disclosed is well calculated to provide the advantages and features above stated, it will be appreciated that the invention is susceptible to modification, variation and change without departing from the proper scope or fair meaning of the subjoined claims.

What is claimed is:

1. A portable and foldable chamber excretion pot comprising:

a pot body having a container, a plurality of clamps disposed along each of three edge walls and a plurality of supporters formed along a fourth edge wall of said container with equal spacing:

a lid having a first edge engaged to one of the four edges of said pot body, and at least one hook being formed at a second, opposite edge of the lid for fitting with or separating from said pot body;

a seat pad having an excretion inlet communicating with said container, a plurality of brackets disposed with equal spacing along three edge walls of said seat pad, and a plurality of revolving members arranged with equal spacing along a fourth edge wall of said seat pad; said revolving members being pivotally entrained on the plurality of supporters such that said seat pad can be lifted up a side opposite to the fourth edge wall;

a plurality of sustainers pivoted to the three edge walls of said seat pad so as to move between folded positions enabling said chamber excretion pot to be folded or developed positions wherein bottom portions of said sustainers are fitted into breaches formed on said plurality of clamps, to maintain the seat pad in a use position; and a bag set under said excretion inlet for accepting excretion.

2. The chamber pot as claimed in claim 1, further comprising a plurality of reinforced ribs provided on a bottom of said seat pad for enhancing strength of said seat pad.

3. The chamber pot as claimed in claim 1, wherein a bottom of at least one of said plurality of sustainers is tapered so that a sloped surface is formed thereon when said at least one sustainer is in the developed position.

4. The chamber pot as claimed in claim 1, wherein each edge wall of said seat pad has a hook for hooking on a periphery of an opening of said bag.

5. The chamber pot as claimed in claim 1, wherein said plurality of revolving members have an arcuate portion facing against a stopper so as to limit a maximum open angle of said seat pad.

6. The chamber pot as claimed in claim 1, wherein said plurality of sustainers are conjoined to a bottom of said seat pad with a pivot axis.

7. The chamber pot as claimed in claim 1, wherein a concavity is formed at a bottom of said pot body for facilitating grasping of the pot body.

8. The chamber pot as claimed in claim 1, further comprising a plurality of clamping arms on opposite sides of said pot body, upper ends of said clamping arms formed into a flange; a plurality of clamp members on said seat pad pivotally engaging the flanges of the plurality of clamping arms such that said seat pad is rotative with respect to said pot body.

* * * * *